US008516733B1

(12) United States Patent
Richey, Jr. et al.

(10) Patent No.: US 8,516,733 B1
(45) Date of Patent: Aug. 27, 2013

(54) FIREARM SHOOTING SUPPORT

(75) Inventors: Claude H. Richey, Jr., Houston, TX (US); Keith B. Willhelm, Houston, TX (US)

(73) Assignee: RRR & Associates, L.L.C., Houston, TX (US)

( * ) Notice: Subject to any disclaimer, the term of this patent is extended or adjusted under 35 U.S.C. 154(b) by 0 days.

(21) Appl. No.: 13/573,229

(22) Filed: Aug. 31, 2012

(51) Int. Cl.
*F41C 23/16* (2006.01)

(52) U.S. Cl.
USPC ..... 42/94

(58) Field of Classification Search
USPC ..... 42/95, 94
See application file for complete search history.

(56) References Cited

U.S. PATENT DOCUMENTS

| | | | | |
|---|---|---|---|---|
| 2,451,473 | A * | 10/1948 | Cooper | 42/74 |
| 4,433,500 | A | 2/1984 | Kunevicius | |
| RE32,752 | E | 9/1988 | Kiang | |
| 5,110,022 | A | 5/1992 | Dvoroznak et al. | |
| 5,332,185 | A | 7/1994 | Walker, III | |
| 5,669,168 | A | 9/1997 | Perry | |
| 5,678,345 | A * | 10/1997 | Gnade | 42/97 |
| 5,964,435 | A | 10/1999 | Peltier et al. | |
| 6,240,671 | B1 * | 6/2001 | Galfidi, Jr. | 42/90 |
| 6,243,979 | B1 | 6/2001 | Seats et al. | |
| 6,986,221 | B2 | 1/2006 | Mullis | |
| 2007/0000163 | A1 | 1/2007 | Buckner | |
| 2008/0307559 | A1 * | 12/2008 | Wright | 2/161.1 |

OTHER PUBLICATIONS

Cabrelas.com, Benches & Rests, http://www.cabelas.com/catalog/browse/shooting-shooting-accessories-benches-rests/__/N-1100226/Ns-CATEGORY_SEQ_104212080?WTz (Aug. 17, 2012).

Cabrelas.com, Shooting Sticks and Bipods, http://www.cabelas.com/catalog/browse/shooting-shooting-accessories-shooting-sticks-bipods/__/N-1100228/Ns-CATEGORY_SEQ_1045648 (Aug. 17, 2012).

Midwayuse.com, CrossTac Saddle Bag Front Shooting Rest, http://www.midwayusa.com/product/617383/crosstac-saddle-bag-front-shooting-rest-bag-nylon-and-toughtek-multicam-black (Oct. 30, 2012).

* cited by examiner

*Primary Examiner* — Stephen M Johnson
(74) *Attorney, Agent, or Firm* — Keith B. Willhelm

(57) ABSTRACT

Shooting supports for rifles and other long barreled firearms are provided for. The novel shooting supports comprise a sleeve and a cushion member. The sleeve has a circumference such that the sleeve is adapted to fit over a forend of a long barreled firearm. The cushion member is carried on the sleeve. It is sized such that when the sleeve is fitted on the forend the cushion member may be positioned under the forend without extending over the forend.

36 Claims, 4 Drawing Sheets

FIREARM SHOOTING SUPPORT

FIELD OF THE INVENTION

The present invention relates to shooting supports for firearms and, more particularly, to a shooting support for rifles and other long barreled firearms.

BACKGROUND OF THE INVENTION

There are a wide variety of products designed to protect firearms from wear and tear as they are used in the field. Most commonly they take the form of protective gloves, that is, specially cut and assembled fabric pieces designed to closely fit over a firearm.

For example, U.S. Pat. No. 4,433,500 to R. Kunevicius discloses protective gloves for rifles and shotguns. Generally speaking, the gloves are fabricated from symmetrical patterns of plasticized polyvinyl chloride fabric connected by narrow elastic portions. The patterns accommodate various projections from the gun, such as the release and trigger, and are assembled in such a way that the fabric forms the side of the gloves with the elastic portions running along the top and bottom of the gun. One version of the glove is designed to slip over the barrel of the gun and extend from the forend all the way to the stock. Other versions have a separate sleeve, fabricated in a similar fashion, that fits only over the forend of the gun. A sleeve adapted to be slipped over the barrel of a gun also is disclosed but few details are provided as to its construction. U.S. Reissued Pat. No. Re. 32,752 to R. Kiang also discloses protective gloves for long barreled firearms. The gloves are fabricated from an elastic sheet that comprises an outer fiber layer, and inner fiber layer, and an intermediate rubber layer. The rubber layer provides a barrier to water, and the seams therein are secured with an adhesive to provide a waterproof seam. One glove disclosed therein is adapted to slip and fit over the forend of the firearm.

Such gloves generally provide adequate protection against scratches, nicks, abrasions and other damage to the finish of a firearm as it is fired and carried in the field. Unlike the typically shiny wooden parts over which they may be installed, those gloves are not light reflective and can help to disguise movement of the firearm. Being waterproof, the gloves of Kiang '752 also help protect a firearm against water damage. Finally, because they are fabricated in whole or in part by elastic materials, they can accommodate a wider variety of guns having differing sizes and configurations.

Such gloves, however, do little to assist a hunter in increasing his opportunities for, and accuracy of shots at game. That is, the materials from which such gloves are made are relatively thin and flexible, as they must be for the glove to closely fit a firearm. While certainly better than nothing at all, thin, flexible material provides minimal muffling of noise if the firearm engages a hard surface. Likewise, such thin, lightweight gloves do little to support and enhance the stability of a firearm as it is being aimed. Thus, various supports for firearms have been developed in an effort to minimize noise that might scare off game and to provide greater stability and support for the firearm as it is aimed and fired.

For example, bags filled with sand, foam balls, polypropylene pellets, cat litter, and the like are commonly used for such purposes. A shooting bag, for example, may be draped over the edge of a hunting blind to support and stabilize a firearm and to muffle any sound as the firearm is laid on the bag. U.S. Pat. No. 5,332,185 to F. Walker III represents a rather sophisticated development of the sand bag concept. Of course, there also are any number of cushioned and uncushioned monopods, bipods, and tripods that can provide adequate support for a firearm as it is aimed. It should be noted, however, that no matter how quietly a firearm may be placed on such supports, not only is carrying them around and setting them up a nuisance, but it can be noisy as well. Thus, such supports are more popularly used in the context of target shooting and less so for hunting.

U.S. Pat. No. 6,986,221 to F. Mullis represents another approach more suitable for hunting. It discloses a sleeve that provides a cushion around the gun forend. One embodiment is assembled from a relatively thick, rectangular resilient body. The resilient body may be made from polyurethane foam, foam rubber, or non-foamed rubber that is capable of absorbing the impact of a gun forend and deadening any sound. It also may be provided with an outer fabric layer. The ends of the resilient body are brought together to form a cylinder and are joined by a strip of elastic material. In another, similar embodiment the ends of the foam body overlap and are secured by hook and loop fasteners, such as Velcro® fasteners.

Mullis '221 also discloses another embodiment in which the body is formed in the shape of a tube eliminating the need for any elastic, hook and loop, or other connections. The material from which the body is composed is not identified specifically, but is described as expandable yet resilient. An outer fabric layer may be provided which necessarily must be expandable to stretch with the tubular body, but to ease stretching the fabric may be omitted.

The cushioned sleeves disclosed in Mullis '221 have certain advantages. Since they are installed on a firearm, there is no need to carry or set up a separate support device. The foam used in those sleeves preferably ranges up to one to two inches thick. Thus, at least in theory, they should be able to muffle any sound that otherwise might occur as a rifle is braced against a hard support. The thick layers of foam also should be able to stabilize a gun to the extent where shooting accuracy is improved.

Despite those advantages, none of the Mullis '221 sleeves appear to have enjoyed any degree of acceptance in the market. The Mullis '221 patent was allowed to expire four years after it issuance for failure to pay the first required maintenance fee. What Mullis and other workers in the art failed to appreciate, however, is that the very features from which its advantages are derived give rise to significant disadvantages as well.

For example, the resilient body extends completely or all but completely around the forend of a firearm. While the relative thickness of the foam can provide support and noise protection, it also can just as easily interfere with gun sights and scopes that may be installed on a firearm. Foam of that thickness also is less elastic, less able to stretch to accommodate firearms with bigger forends. Elastic connecting bands or overlapping joints, therefore, are employed in sleeves fabricated from thick foam material so that they can accommodate forends of greater or lesser circumference.

On the other hand, if a tubular sleeve is constructed entirely of a relatively thick foam, without any elastic bands or overlapping ends, any accommodation of different sizes will largely result from radial compression of the foam, not elastic expansion about the circumference. Such compression may occur on larger forends to an extent that stability and noise suppression is compromised. Excess compression also may put pressure on a floating barrel, causing it to contact the stock, or otherwise interfere with the natural harmonics of the barrel, which in turn can diminish the accuracy of a shot.

Thick foam sleeves also are not well suited for sliding over a barrel, as such resilient foams typically do not slide easily over metal and wooden surfaces when they are under compression. Finally, given that the resilient body also must have sufficient structural integrity to form the body of a sleeve, the choice of cushioning materials used in the sleeve are limited.

Accordingly, there remains a need for new and improved shooting supports for rifles and other long barreled firearms. Such disadvantages and others inherent in the prior art are addressed by various aspects and embodiments of the subject invention.

SUMMARY OF THE INVENTION

The subject invention, in its various aspects and embodiments, is directed generally to shooting supports for firearms and, more particularly, to a shooting support for rifles and other long barreled firearms. One aspect of the invention provides for a shooting support for a firearm which comprises a sleeve and a cushion member. The sleeve has a circumference such that the sleeve is adapted to fit over a forend of a long barreled firearm. The cushion member is carried on the sleeve. It is sized such that when the sleeve is fitted on the forend the cushion member may be positioned under the forend without extending over the forend.

Another aspect provides for a shooting support for a firearm that comprises an elastic sleeve, a pocket, and cushioning material. The elastic sleeve has a circumference such that the sleeve is adapted to expand outwardly to accommodate a forend of a long barreled firearm. The pocket is provided on the sleeve and captures the cushioning material. The cushioning material extends across a portion of the sleeve circumference such that when the sleeve is installed around the forend the cushioning material may be positioned under the forend without extending over the forend.

Yet another aspect provides for shooting supports where the cushion is a resilient foam body, while other aspects provide for supports with a cushion comprising a gel pack, a deformable mass of particles, or a deformable packet of particles. Other aspects provide for shooting supports where the sleeve is fabricated, in whole or in part, from an elastic web. Yet other aspects provide for sleeves where the elastic web is a foamed rubber composite material or another preferred elastic material.

Yet other aspects provide for shooting supports where the sleeve is relatively thin, preferably less that about 4 millimeters thick. Other aspects provide for shooting sleeves fabricated from a pair of sleeve pieces and a pocket piece or other preferred pattern pieces.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and to by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

Figure 1:
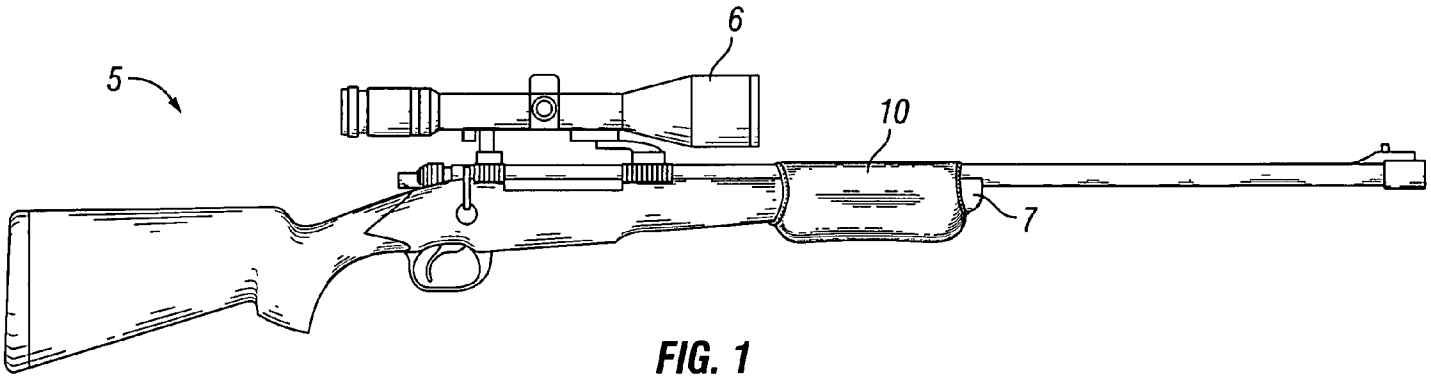
FIG. 1 is a perspective view of a preferred embodiment 10 of the shooting supports of the subject invention showing support 10 installed on a prior art bolt action rifle.

In the drawings and description that follows, like parts are identified by the same reference numerals. The drawing figures are not necessarily to scale. Certain features of the invention may be shown exaggerated in scale or in somewhat schematic form and some details of conventional design and construction may not be shown in the interest of clarity and conciseness.

DESCRIPTION OF ILLUSTRATIVE EMBODIMENTS

The subject invention is directed to shooting supports for a firearm. Certain broad embodiments of the invention comprise a sleeve having a circumference such that the sleeve is adapted to fit over a forend of a long barreled firearm. The support also comprises a cushion member carried on the sleeve. The cushion member is sized such that when the sleeve is installed around the forend the cushion member may be positioned under the forend without extending over the forend.

Other broad embodiments comprise an elastic sleeve. The elastic sleeve has a circumference such that the sleeve is adapted to expand outwardly to accommodate a forend of a long barreled firearm. A pocket is provided on the sleeve. The pocket captures cushioning material which extends across a portion of the sleeve circumference such that when the sleeve is installed around the forend the cushioning material may be positioned under the forend without extending over the forend.

For example, a preferred embodiment of the novel shooting support is shown in FIGS. 1-5. A may be seen in FIG. 1, support 10 is adapted to be installed on a conventional long barreled firearm, such as prior art bolt action rifle 5 having a sighting scope 6 mounted thereon. More particularly, support 10 is adapted for installation on the forend 7 of rifle 5.

Figure 3:
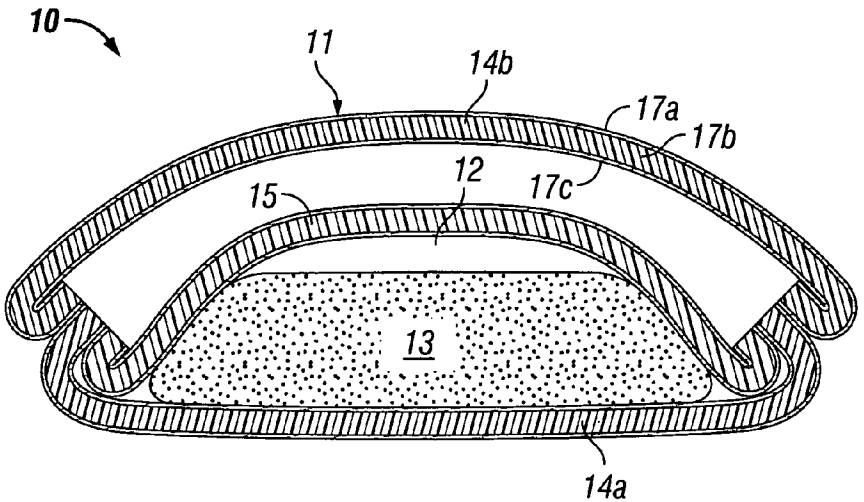
FIG. 3 is a cross-sectional view taken along line 3-3 of FIG. 2 of novel support 10.
Figure 2:
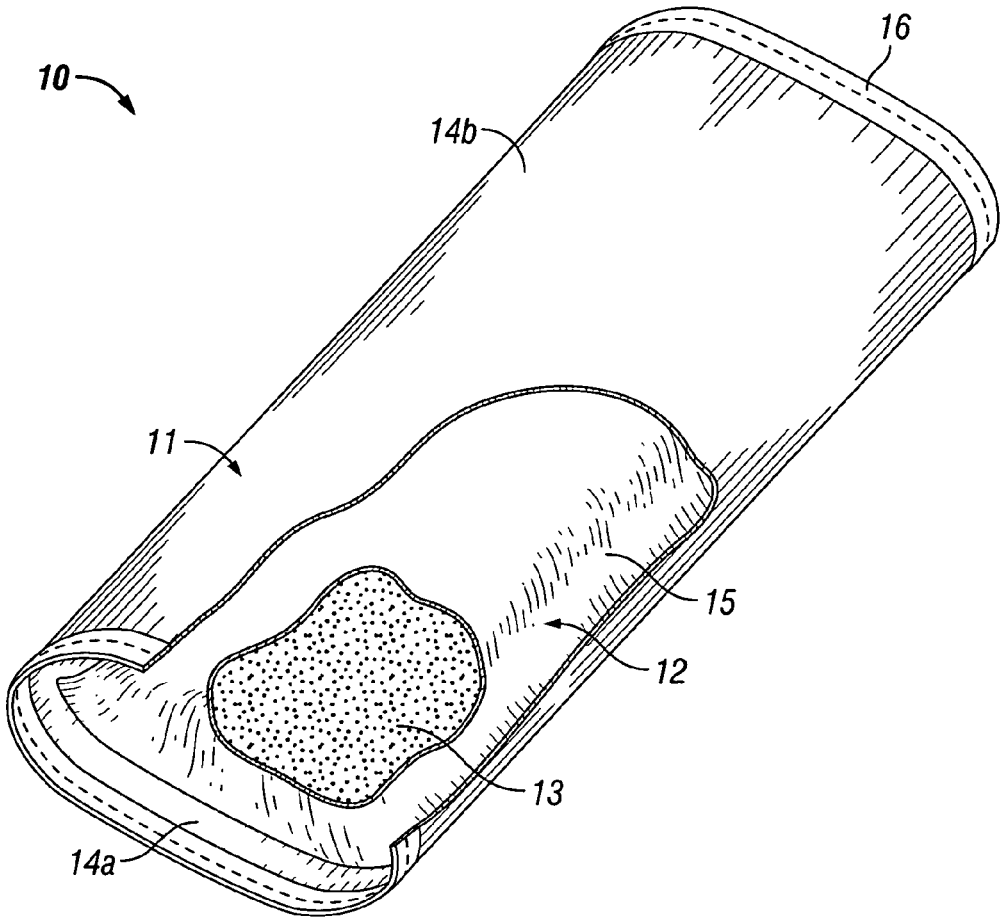
FIG. 2 is a perspective view, including partial tear-away views of novel support 10 shown in FIG. 1.

As may be seen in FIGS. 2-3, support 10 generally comprises a sleeve 11. Sleeve 11 is provided with a pocket 12 in which is carried a cushion 13. Sleeve 11 is generally tubular, although in its uninstalled state it may flatten or collapse somewhat. Pocket 12 is provided on the inside of sleeve 11. Pocket 12 and cushion 13 generally run the length of sleeve 11. The width of pocket 12 and cushion 13 are sized such that when support 10 is installed on, for example, rifle 5, and rifle 5 is placed on a hard support, such as an opening in a deer blind, cushion 13 may be positioned under forend 7 to stabilize rifle 5 and to muffle any sound that might otherwise be created by positioning rifle 5.

Pocket 12 and cushion 13, for example, may have a width approximately equal to one-half the circumference of sleeve 11. Such sizing is somewhat advantageous because it provides a sufficient width to cushion 13 so that it can extend under and beyond the lower surface of most firearm forends, but yet allows sleeve 11 to collapse and flatten nicely, thereby providing a compact form for shipment and a neat appearance for retail display. Substantial variations from such sizing are equally effective, however, in terms of the support's performance in the field. In any event, because cushion 13 is sized such that it extends primarily under the forend of most long barreled firearms instead of over, the cushion in the novel supports may be made as thick as may be desired for stabilizing the firearm and muffling noise without interfering with its sights or scopes.

Figure 4:
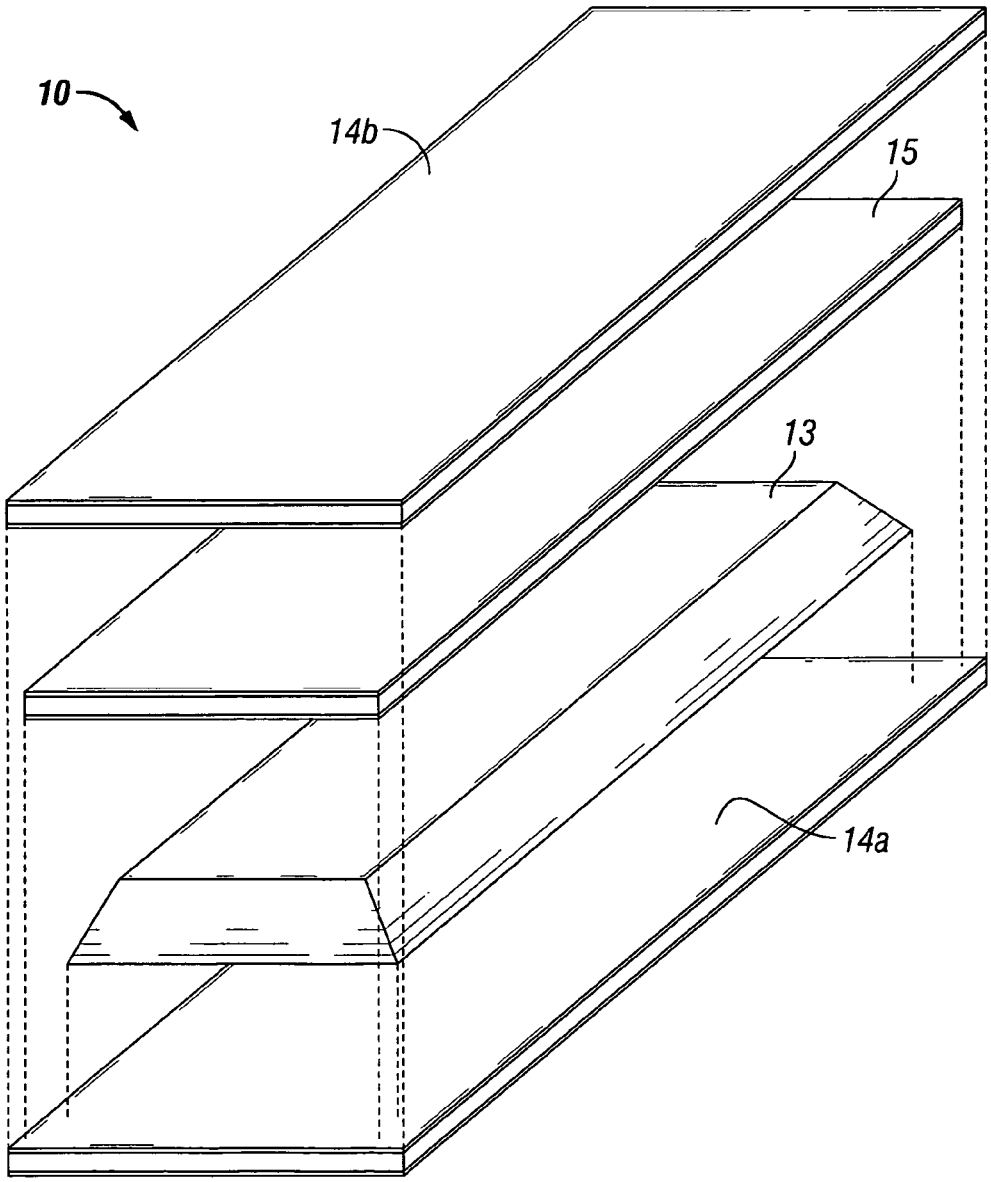
FIG. 4 is an exploded perspective view showing various components from which novel support 10 is assembled.
Figure 5:
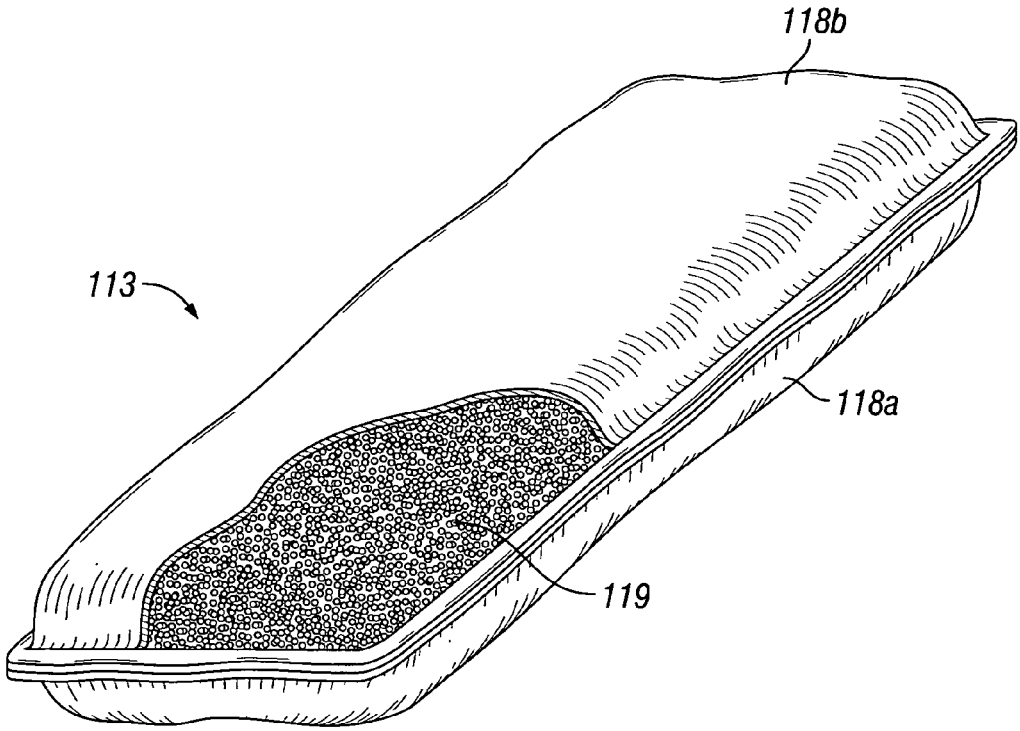
FIG. 5 is a perspective view of a second preferred cushion which may be used in novel support 10 and other embodiments of the shooting supports of the subject invention.

The sleeves of the novel shooting supports preferably are assembled from various pieces cut from a web of fabric or other material. For example, as best seen in FIG. 4, sleeve 11 is fabricated from a first sleeve piece 14*a*, a second sleeve piece 14*b*, and a pocket piece 15. If desired, the ends of sleeve pieces 14 or pocket piece 15 may be finished with, for example, bias tape 16. When such patterns are used, sleeve 11 preferably is assembled by sewing the pattern pieces "inside-out." That is, first and second sleeve pieces 14*a* and 14*b* may be placed with what will be their face or "show" sides facing each other and then sewn together along their sides. Pocket piece 15 then may be sewn along its sides to the assembly of sleeve pieces 14, preferably on, or in the seam allowance of the existing seams, thus forming pocket 13. The assembly of sleeve pieces 14 and pocket piece 15 then is turned "outside-in" so that the show sides of sleeve pieces 14 are on the outside of sleeve 11, pocket piece 15 is between sleeve pieces 14, and the seam allowances are turned inside. Cushion 13 then may be inserted into pocket 12 and the open ends thereof sewn shut.

It will be appreciated, however, that while the exemplified method of assembling sleeve and pocket allow for easy, efficient manufacture of the novel supports, the invention is not limited thereto. The sleeve of the novel supports may be made from a variety of patterns, including patterns for the simultaneous assembly of multiple sleeves. Such patterns may include a preassembled pocket which is sewn, tacked or otherwise carried on the sleeve. Likewise, pattern pieces may be assembled not only by sticking, but also by adhesives, heat bonding, or other methods as may be appropriate for the choice of fabric.

In accordance with preferred aspects of the invention, the sleeve of the novel shooting supports is elastic, and toward that end, the sleeve preferably is fabricated in whole or in part from an elastic web. For example, the pattern pieces 14 and 15 of sleeve 11 are cut from a sheet of elastomeric material. More particularly, as may be seen best in FIG. 3, the elastomeric material is a composite material having a core layer made of rubber 17*b*, an elastic fabric facing 17*a* on the show side, and an elastic fabric lining 17*c* on the back side.

Core layer 17*b* preferably is a foamed chloroprene (neoprene) rubber, but a variety of other suitable elastic, foamed and unfoamed rubbers are commercially available and may be used, such as chloroprene, 2,3-dichloro-1,3-butadiene copolymer or other chloroprene copolymers, butadiene acrylonitrile, ethylene propylene, silicone, fluorosilicone, fluorinated hydrocarbon, polyisoprene, styrene butadiene, polyester/polyurethane, polyurethane, isobutylene isoprene, epichlorohydrin, and chlorosulfonated/polyethylene rubbers, and various copolymers and blends thereof. Fabric facing 17*a* and lining 17*c* typically will be a woven or knitted fabric, such as a nylon fabric, that incorporates elastic fibers, such as natural rubber, latex, or elastane fibers. The fabric preferably has four-way stretch, but two-way stretch may be used as the sleeve will have to accommodate primarily outward expansion. A variety of suitable fabrics, such as spandex, are known and are commercially available, as are a number of neoprene and other composite materials of suitable construction. While not necessarily undesirable, the elastic web does not have to have significant resilient compressibility, as its primary purpose will be to provide circumferential stretch in the sleeve and not to cushion or support the firearm. That latter function will be provided primarily by the cushion.

Such materials and neoprene composites in particular are known for their durability, yet are quite elastic and may be sewn relatively easily. The fabric facing also provides a show side that may be dyed or patterned as with any other fabric to provide a variegated or camouflaging pattern or whatever pattern may be desired. The fabric also provides an excellent substrate upon which logos, trademarks, slogans and the like may be applied, for example, by silk screening. More importantly, however, the fabric facing and lining protects the rubber core, with the fabric lining also providing a slick inner surface for the sleeve which greatly facilitates installation and removal of the support.

Such composite materials are preferred, but the invention is not limited thereto. Unfaced and unlined rubber sheets may be used. They may be more susceptible to wear and tear, and they may tend to stick as they are slid on and off a firearm, but such considerations may not always be paramount, especially if cost is a consideration. It also will be appreciated that the sleeve may be formed from any two-way or four-way stretch elastic fabrics. Such materials also may not be as durable as, for example, a neoprene composite material, but they are lightweight, inexpensive, and may be sewn more easily than heavier composite materials. Elastic mesh also may be used. Finally, it will be appreciated that only a portion of the sleeve may be fabricated from an elastic material. For example, top sleeve piece 14*b* may be fabricated from an elastic neoprene composite, while bottom sleeve piece 14*a* may be fabricated from inelastic materials, such as leather or an aramid fabric such as Kevlar®, which may be more desirable from an aesthetic or wear perspective.

In any event, it will be appreciated that the web materials from which the sleeves of the novel support are fabricated are relatively thin. If a composite neoprene material is used, for example, it preferably is less than about 4 millimeters thick, more preferably less than about 3 millimeters thick. Thus, when they are installed on a rifle, and the cushion is positioned under the forend, the novel supports will not interfere with use of the rifle sights or a shooting scope installed on the rifle.

In general the cushion of the novel supports may be fabricated from any material, or provided by any assembly sufficient to cushion and muffle any impact between the firearm and a solid support and to stabilize the barrel of a firearm once it is laid to rest on the solid support. Thus, the cushion typically will be soft enough, or deformable enough to allow the firearm to sink into the cushion somewhat while at a minimum substantially reducing the likelihood of inelastic contact between the firearm and a hard support.

For example, and in accordance with other preferred aspects of the invention, cushion 13 is fabricated from a resilient manufactured foam. As may be seen in FIG. 4, foam body has the general shape of a truncated, rectangular pyramid. Alternately, it may be viewed as a solid rectangle in which bevels are provided on its sides and ends. Bevels allow the sides of cushion 13 to more readily wrap around the bottom of forend, while bevels on the ends of cushion 13 present a ramped surface when support 10 is installed from either of its ends.

The foam body preferably is fabricated from a closed cell acrylonitrile butadiene/polyvinyl chloride (AB/PVC) flexible foam such as Rubatex™ or Armaflex™ foam. Such foams may be molded or cut into a variety of shapes and provide effective, cost efficient cushioning and stability for a rifle. They also are extremely durable and weather resistant. Other manufactured rubber foams, or unfoamed rubbers, may be used, however, such as the rubbers mentioned above. The foam preferably has good resiliency and good compression set characteristics to avoid compression of the foam over extended use.

A gel pac or cushion also may be used if desired. Typically, such cushions comprise a polyurethane or other rubber gel enveloped in a film, typically a thermoplastic film. Such gel cushions also may be molded into a variety of shapes suitable for use in the subject invention.

Similarly, the cushioning material may comprise a deformable mass of particles, such as sand, foam balls, polypropylene pellets, cat litter, silica gel beads, or other particles commonly used in fabricating shooting bags. Such masses may be sewn or sealed inside a pocket in the novel supports. For example, pocket 12 of support 10 may be filled with a mass of particles and then sewn up. Preferably, however, the particles are prepackaged in a packet, such as packet 113 shown in FIG. 5. Packet 113 is a four-sided packet formed from two web pieces 118*a* and 118*b*, such as paper or plastic film, that are adhered, bonded, or otherwise joined around the edges. A deformable mass of particles, such as foam balls 119, are packaged therein. By pre-packaging the deformable mass in a packet assembly of the novel supports may be greatly simplified. Packet 113, for example, may simply be inserted into pocket 12 of support 10 instead of foam cushion 13.

The pocket in the novel sleeves preferably is substantially completely enclosed to provide the maximum protection for the cushioning material therein. On the other hand, when the cushion is an integral mass, such as a foam body, a gel pack, or a deformable packet, it may not be necessary to completely enclose the cushion to effectively capture the cushioning material on or in the sleeve. The pocket may be left somewhat open, as various cutaways may save fabric yet still allow the pocket to effectively capture cushioning material. Pockets consisting of cooperating strips of material may be used to capture the cushioning material inside or out of the sleeve, although for aesthetic reasons such approaches may be more suited for use when the cushion is disposed inside a sleeve. The pocket also may be eliminated altogether in favor of simply affixing the cushion to the sleeve. For example, a foam body may be adhered to the sleeve, or it may be tacked down with thread or other penetrating fasteners At the same time, however, it also will be appreciated that by enclosing or otherwise capturing the cushion in a pocket, without otherwise affixing it to the sleeve, only the sleeve need be elastic. There is no need for the cushion to be elastic. That is, the cushion need not be stretchable, either two-way or four-way, because the sleeve is able to expand outwardly to accommodate larger forends. The cushion is not attached to the sleeve and is only carried in the pocket. It does not have to stretch with any part of the sleeve, even the pocket. Thus, for example, a foam body cushion may be made as thick as is desired despite the fact the elasticity of such foams decreases as the thickness increases. Indeed, relatively thick foams may be sufficiently inelastic that they are unsuitable for use when, as in various prior art supports, they must stretch to accommodate larger forends.

A pocket also enables the use of other cushioning materials, such as deformable particle masses, which may provide very desirable cushioning properties, but which have not been susceptible to use in sleeve-type shooting supports. Moreover, when a cushion is disposed inside a sleeve, providing a pocket that substantially covers the cushion with a fabric web or a fabric faced web ensures that the sleeve will slide easily on and off a rifle. Otherwise, many cushioning materials, such as elastomeric foams and gel packs, may tend to stick and hang up.

Embodiments of the subject invention are commercially available from the assignee of the subject application and are sold under the RRR® mark (www.rrrgunrest.com). Those shooting supports are constructed substantially as shown in respect to novel support 10. The RRR gun rest is approximately 8" long and has a circumference of approximately 7". The sleeve is fabricated from a closed cell neoprene composite faced and lined with a four-way, elastic nylon fabric having a thickness of approximately 3 mm. The cushion is a foam body which is approximately 0.5" thick, 3"×6" at its base, and has 45° bevels on its sides. It is fabricated from a relatively soft Armaflex™ foam.

It has been found that the RRR gun rest is sufficiently elastic to comfortably accommodate rifle forends of from about 1.25 to about 2.25 inches wide, such rifles constituting the vast majority of rifles currently available. It will remain snugly on the rifle as it is carried about on a hunt, but at the same time, it does not apply excessive pressure on a barrel and does not interfere with a floating barrel or the natural harmonics of a barrel. The RRR gun rest also provides a high level of stability for a rifle as it is aimed and fired and substantially eliminates all contact noise as the rifle is laid on a hard support, all without interfering with the sights or scopes on most rifles. The fabric facing and lining protects the elastomeric sleeve from wear and tear, and the fabric lining provides a slick surface allowing the sleeve to be slipped easily on and off a firearm. The RRR gun rest is rugged, durable, and unaffected by any weather conditions to which hunters may be exposed. It comes with a lifetime warranty.

While this invention has been disclosed and discussed primarily in terms of specific embodiments thereof, it is not intended to be limited thereto. Other modifications and embodiments will be apparent to the worker in the art.

What is claimed is:

1. A shooting support for a firearm, said support comprising:

(a) an elastic sleeve forming a continuous uninterrupted loop and having a circumference such that said sleeve is adapted to fit over a forend of a long barreled firearm;

(b) a cushion member carried on said sleeve, said cushion member being sized such that when said sleeve is fitted on said forend said cushion member may be positioned under said forend without extending over said forend.

2. The shooting support of claim 1, wherein said cushion member is a resilient foam body.

3. The shooting support of claim 2, wherein said elastic sleeve is fabricated from an elastic web.

4. The shooting support of claim 2, wherein said elastic sleeve is fabricated from an elastic web comprising an elastomeric layer and a fabric layer.

5. The shooting support of claim 4, wherein said elastomeric layer is a foamed rubber.

6. The shooting support of claim 4, wherein said elastic web has a fabric lining and a fabric facing.

7. The shooting support of claim 1, wherein said cushion member is a gel pack.

8. The shooting support of claim 1, wherein said cushion member is a deformable mass of particles.

9. The shooting support of claim 1, wherein said cushion member is a deformable packet of particles.

10. The shooting support of claim 1, wherein said sleeve is elastic and is adapted to expand outwardly to accommodate said forend.

11. The shooting support of claim 1, wherein said sleeve is fabricated from an elastic web comprising an elastomeric layer and a fabric lining.

12. The shooting support of claim 11, wherein said elastomeric layer is a foamed rubber.

13. The shooting support of claim 11, wherein said elastic web has a fabric lining and a fabric facing.

14. The shooting support of claim 1, wherein said elastic sleeve is adapted to provide sufficient elastic forces to retain said support on the forend of said firearm.

15. The shooting support of claim 1, wherein said shooting support is mounted around the forend of said long barreled firearm such that said cushion member is positioned under said forend and does not extend over said forend.

16. The shooting support of claim 1, wherein said elastic sleeve is fabricated from an elastic web.

17. A shooting support for a firearm, said support comprising:

(a) an elastic sleeve, said sleeve forming a continuous uninterrupted loop and having a circumference such that said sleeve is adapted to expand outwardly to accommodate a forend of a long barreled firearm;

(b) a pocket provided on said sleeve; and (c) cushioning material captured by said pocket, said cushioning material extending across a portion of said sleeve circumference such that when said sleeve is installed around said forend said cushioning material may be positioned under said forend without extending over said forend.

18. The shooting support of claim 17, wherein said pocket has a width equal to approximately one half the circumference of said sleeve.

19. The shooting support of claim 17, wherein said cushioning material comprises a resilient foam body.

20. The shooting support of claim 19, wherein said foam body has a length substantially equal to the length of said sleeve and a width equal to approximately one half the circumference of said sleeve.

21. The shouting support of claim 17, wherein said elastic sleeve is fabricated from an elastic web.

22. The shooting support of claim 17, wherein said elastic sleeve is fabricated from an elastic web comprising an elastomeric layer and a fabric layer.

23. The shooting support of claim 22, wherein said elastomeric layer is a foamed rubber.

24. The shooting support of claim 22, wherein said elastic web has a fabric lining and a fabric facing.

25. The shooting support of claim 17, wherein said cushioning material is a foam body in the shape of a solid rectangle having at least one beveled end.

26. The shooting support of claim 17, wherein said cushioning material is a gel pack.

27. The shooting support of claim 17, wherein said cushioning material is a deformable mass of particles.

28. The shooting support of claim 17, wherein said cushioning material is a deformable packet of particles.

29. The shooting support of claim 17, wherein said elastic sleeve is fabricated from an elastic web.

30. The shooting support of claim 29, wherein said elastic sleeve is fabricated from a foamed rubber composite material.

31. The shooting support of claim 30. wherein said elastic web has a fabric lining and a fabric facing.

32. The shooting support of claim 17, wherein only a portion of said elastic sleeve is fabricated from an elastic web.

33. The shooting support of claim 17, wherein said elastic sleeve is less than about 4 millimeters thick.

34. The shooting support of claim 17, wherein said elastic sleeve is fabricated from a pair of sleeve pieces and a pocket piece.

35. The shooting support of claim 17, wherein said elastic sleeve is adapted to provide sufficient elastic forces to retain said support on the forend of said firearm.

36. The shooting support of claim 17, wherein said shooting support is mounted around the forend of said long barreled firearm such that said cushioning material is positioned under said forend and does not extend over said forend.

* * * * *